US005487202A

United States Patent [19]

Cowan

[11] Patent Number: 5,487,202

[45] Date of Patent: Jan. 30, 1996

[54] FLOOR MOPPING DEVICE WITH WHEELED SUPPORT FRAME

[76] Inventor: Gloria L. Cowan, 2720 Wilkinson Rd., Sarasota, Fla. 34231

[21] Appl. No.: 370,376

[22] Filed: Jan. 9, 1995

[51] Int. Cl.[6] ..... A47L 13/258; B62B 1/14; B62B 1/00

[52] U.S. Cl. ..... 15/228; 15/147.1; 15/229.7; 280/47.131; 280/47.17; 280/47.20; 280/47.24

[58] Field of Search ..... 15/229.1–229.9, 15/147.1, 147.2, 150, 151, 148, 149, 152, 154, 146, 245, 228, 246; 280/417.17, 417.33, 47.20, 47.33, 47.24, 47.131

[56] References Cited

U.S. PATENT DOCUMENTS

| | | | |
|---|---|---|---|
| D. 342,361 | 12/1993 | Williams et al. | D34/24 |
| 492,487 | 2/1893 | Reardon | 15/79 R |
| 1,196,397 | 8/1916 | Przespoleski | 15/146 |
| 1,525,617 | 2/1925 | Mills | 15/79 R |
| 2,440,014 | 4/1948 | Ludwick | 15/150 |
| 2,890,470 | 6/1959 | Shaefer | 15/229.4 |
| 3,029,454 | 4/1962 | Short et al. | 15/147.1 |
| 3,440,677 | 4/1969 | Flomerfelt | 15/229.8 |
| 3,991,431 | 11/1976 | Thielen | 15/228 |
| 4,358,123 | 11/1982 | Richards | 15/246 |
| 4,685,167 | 8/1987 | Murray | 15/147.2 |
| 4,797,618 | 1/1989 | De Vries | 280/47.13 |
| 4,807,323 | 2/1989 | Karpp | 15/228 |
| 4,829,755 | 5/1989 | Nance | 56/17.1 |
| 4,845,800 | 7/1989 | Pederson et al. | 15/228 |
| 5,054,278 | 10/1991 | Thorndike | 56/400.14 |
| 5,222,750 | 6/1993 | Ellis | 280/47.33 |

FOREIGN PATENT DOCUMENTS

| | | | |
|---|---|---|---|
| 556185 | 4/1957 | Belgium | 15/229.4 |
| 945537 | 7/1956 | Germany | 15/149 |

*Primary Examiner*—David Scherbel
*Assistant Examiner*—Gary K. Graham
*Attorney, Agent, or Firm*—Charles J. Prescott

[57] ABSTRACT

A floor mopping device including a main frame having two laterally spaced floor engaging wheels and a downwardly sloping elongated push handle longitudinally adjustably connected thereto. A lower forward end of the push handle is connected to a transversely oriented elongated support bar which is oriented horizontally just above the floor when the device is in use or at rest. At least one, and preferably two, end-to-end elongated flat support plates or wire frames are pivotally connectable beneath the support bar. A removable cleaning pad coextensive with and releasibly attachable to a bottom surface of each support plate or wire frame cleaningly engages flat atop the floor when the device is in use.

2 Claims, 2 Drawing Sheets

FLOOR MOPPING DEVICE WITH WHEELED SUPPORT FRAME

BACKGROUND OF THE INVENTION

1. Scope of the Invention

This invention relates generally to floor maintenance devices, and more particularly to a self-supporting floor mop which reduces the manual effort required to damp mop or dust mop a large floor area.

2. Prior Art

Manually operated or push-type mopping devices for cleaning large floor areas as halls, gymnasiums and even bowling alley lanes and the like are well known. Typically, these devices are structured having an elongated, straight push handle connected at a lower end thereof to a transversely extending plate or frame to which is releasably attachable to an elongated cleaning pad or cover. However, because of the manual exertion required to both support the handle and propel and turn the device across the floor in a regular back and forth pattern, the overall length of the floor cleaning implement supposed within the support plate or wire frame must be limited in overall length.

A number of devices are known to generally attempt to enhance the cleaning effectiveness of floor mops. A family of unpatented floor care products such as those distributed by West Florida Supply Company of Sarasota, Fla., include conventional dry and wet floor mops as shown typically in FIGS. 1, 2A and 2B of the drawings and further discussed in the Detailed Description.

In U.S. Pat. No. 4,807,323, Karpp discloses a floor mop having a support for holding an attachment having a fringed underside or a raised pile washing attachment and specific attaching structure. This device is otherwise of a conventional nature.

Several devices, all manually propelled by unsupported elongated handles, incorporate a replenishable supply of cleaning material in roll form for storage in the device. These devices are shown in the following patents but are somewhat unrelated to the present invention:

| | |
|---|---|
| Lemelson | 4,106,153 |
| Johnson et al. | 4,550,467 |
| Davis et al. | 4,562,610 |
| Ham | 4,914,773 |

A cleaning device disclosed in U.S. Pat. No. 3,597,785 invented by Zinda teaches a conventional dust pan having a transverse roller positioned just rearward of the leading edge of the dust pan to facilitate its effective use through rolling engagement atop the floor.

The present invention provides a self supported floor mopping and dusting device which includes a wheel-supported main frame connected to an elongated push handle, the lower end of which is attachable via an elongated support bar to either single or multiple cleaning head support plates or wire frames which, in turn interengage the floor with either raised pile or fringe covered floor engaging members.

BRIEF SUMMARY OF THE INVENTION

This invention is directed to a floor mopping device including a main frame having two laterally spaced floor engaging wheels and a downwardly sloping elongated push handle longitudinally adjustably connected thereto. A lower forward end of the push handle is connected to a transversely oriented elongated support bar which is oriented horizontally just above the floor when the device is in use or at rest. At least one, and preferably two, end-to-end elongated flat support plates or wire frames are pivotally connectable beneath the support bar. A removable cleaning pad coextensive with and releasably attachable to a bottom surface of each support plate or wire frame cleaningly engages flat atop the floor when the device is in use.

It is therefore an object of this invention to provide a self-supporting floor damp mopping and dust mopping device which reduces the manual effort required in cleaning large floor surfaces.

It is yet another object of this invention to provide a floor mopping device which reduces the overall time required to clean large floor surfaces.

It is yet another object of this invention to provide a floor damp mopping and dust mopping device which may be used in conjunction with either single or multiple cleaning heads for substantially reduced floor cleaning time.

It is yet another object of this invention to provide a self-supporting floor damp mopping and dust mopping device which is adjustable in push handle height to accommodate variations in operator height.

In accordance with these and other objects which will become apparent hereinafter, the instant invention will now be described with reference to the accompanying drawings.

DETAILED DESCRIPTION OF THE INVENTION

Figure 1:
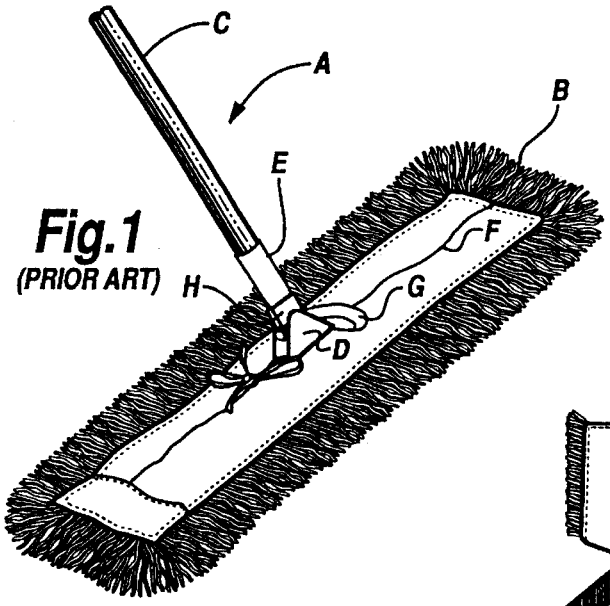
Fig.1 (PRIOR ART)
FIG. 1 is a perspective view of a prior art floor mopping and dusting device.
Figure 2A:
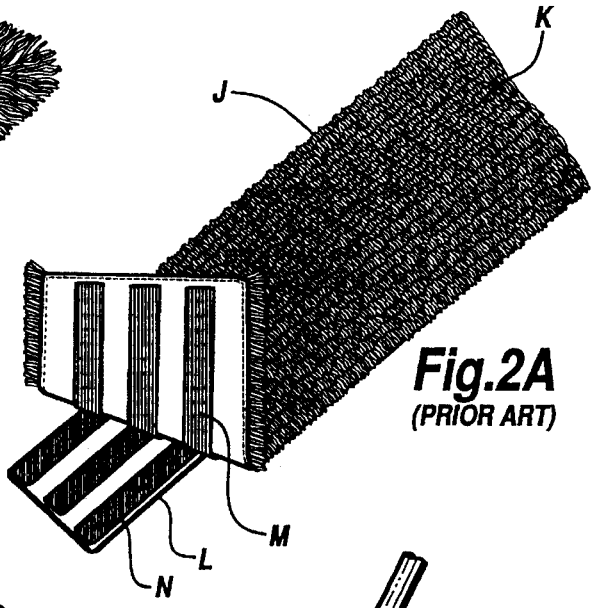
Fig.2A (PRIOR ART)
FIG. 2A is an inverted perspective view of a prior art support plate having a raised pile floor cleaning member attached thereto.
Figure 2B:
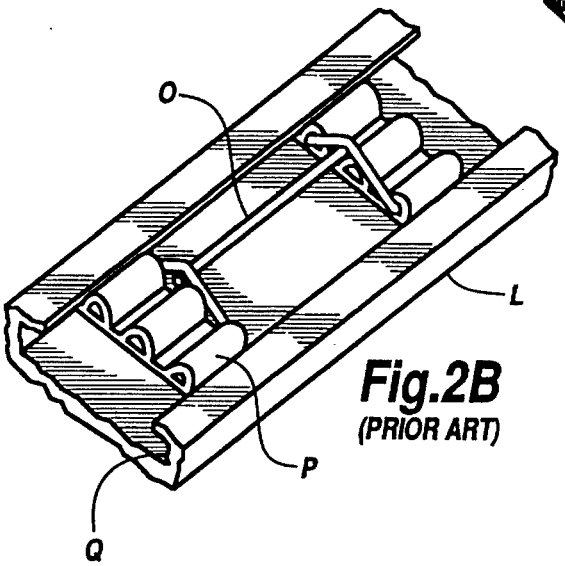
Fig.2B (PRIOR ART)
FIG. 2B is an enlarged view of an upright elongated support plate (L) of FIG. 2A.

Referring now to the drawings, and particularly to FIGS. 1, 2A and 2B, the prior art devices known to applicant which perform a similar function to that of the present invention are there shown. In FIG. 1, a conventional floor mopping device is shown generally at numeral A and includes a dusting or cleaning pad or cover B defining a bottom surface of closely spaced fabric fringe similar to shag carpet fitted around and held in place surrounding a wire support frame (not shown). The cleaning cover B is held in position by securing hand ties G positioned centrally adjacent either side of a swivel clip D at the ends of slits F. Alternately, a slide-on cover (not shown) may be used. This clip D biasingly engages with a wire bracket of the wire frame (not shown) but similar in structure to the clip O in FIG. 2B. Movable block H either prevents or allows swivel action of handle support E with respect to clip D. An elongated rigid wooden handle C secured at its lower end into handle support E is also provided, the upper end of handle C being used in a conventional way by an operator to push the entire device A across the floor during cleaning.

In FIG. 2A, another embodiment of a floor engaging cleaning pad is shown inverted at J and includes an elongated rigid or semi-rigid plastic elongated support plate L having an elongated rectangular raised pile carpet cleaning pad K attached thereto by mating strips of hook and pile material N and M. In FIG. 2B, the upper central surface of the support plate L includes a wire attaching bracket O which interengages with clip D of FIG. 1 in a similar way for both pivotal and swivel or universal motion of the handle C as the cleaning pad J is manually pushed across the floor surface. Rubber locking members P, positioned and secured as by gluing within channels Q, hold the bracket O in desired position.

Figure 3:
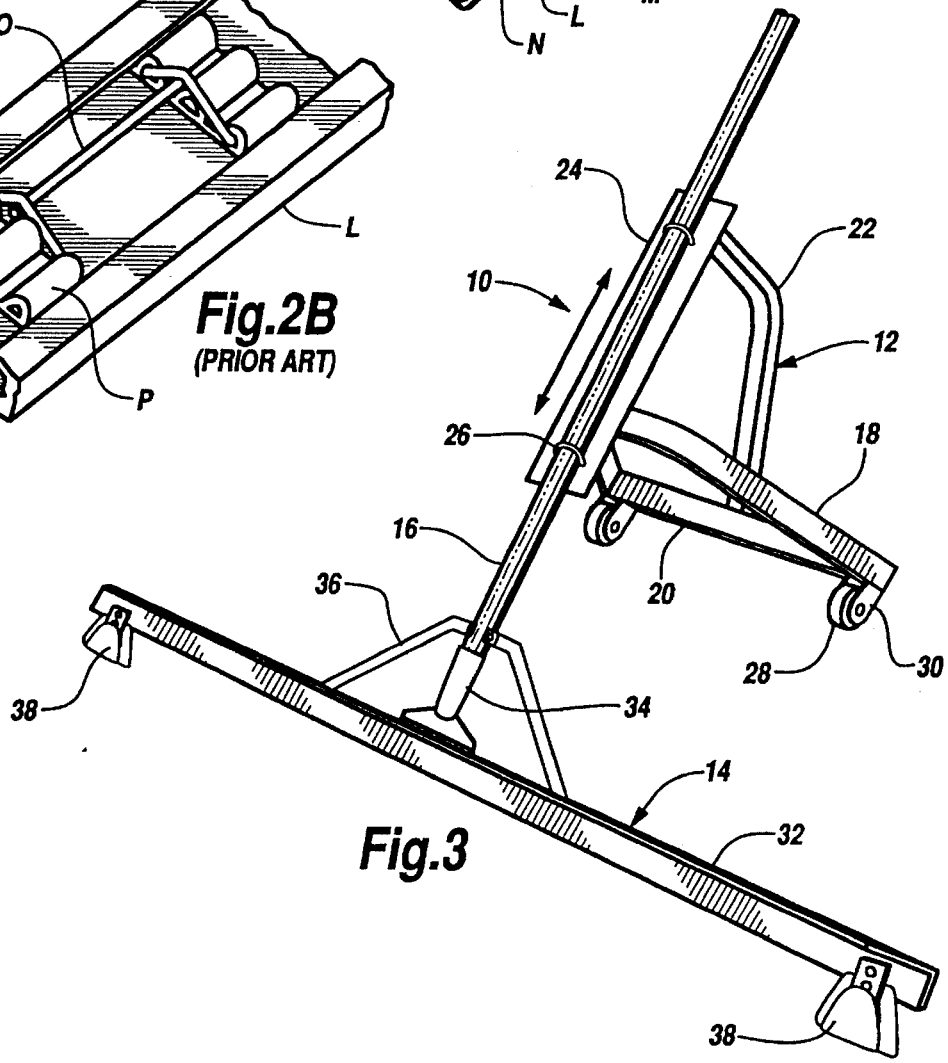
FIG. 3 is a perspective view of the preferred embodiment of the invention.
Figure 4:
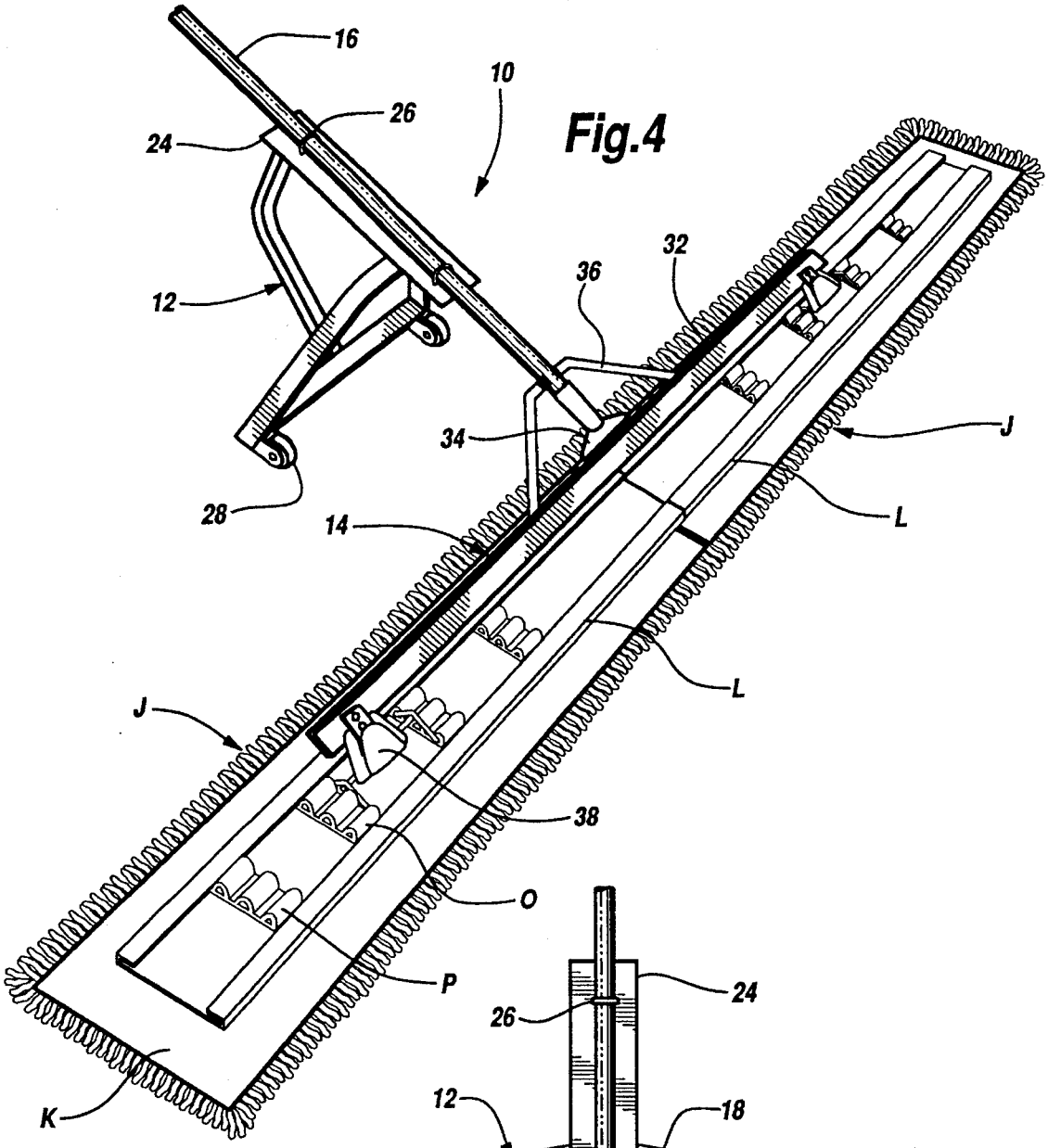
FIG. 4 is a perspective view of the invention shown in FIG. 3 operably engaged with two end-to-end prior art floor support plates and floor cleaning members shown in FIG. 2A.
Figure 5:
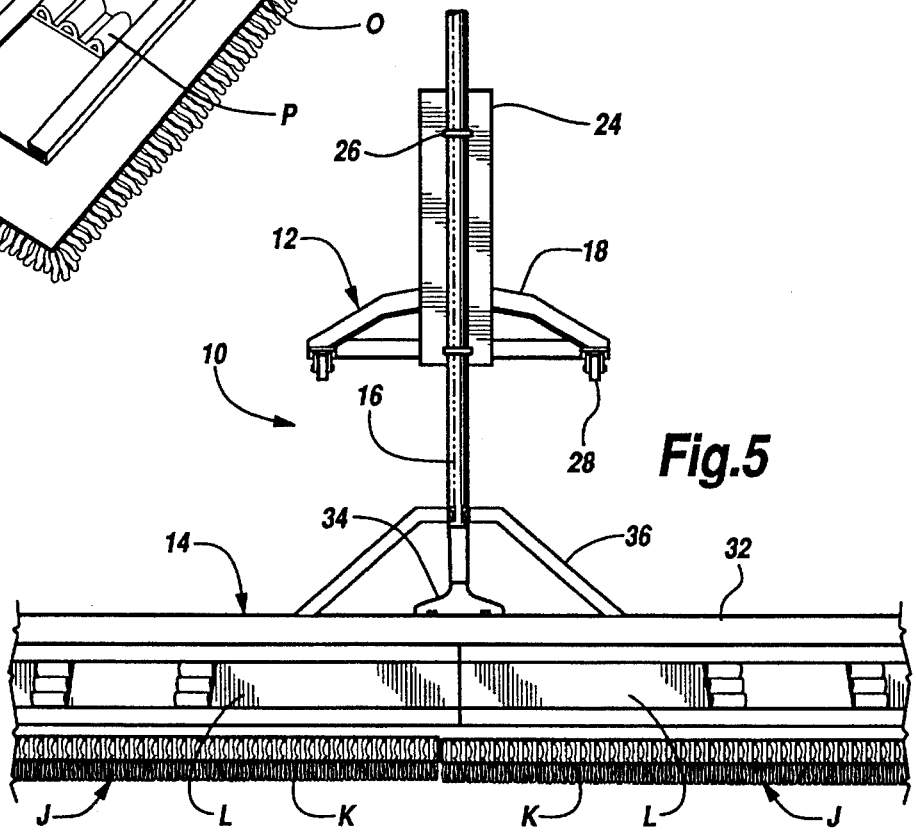
FIG. 5 is a front perspective view of FIG. 4.

Referring now to FIGS. 3 to 5, the preferred embodiment of the invention is shown generally at numeral 10 and includes a main frame 12 and a floor cleaning assembly 14, the main frame 12 being formed of tubular rigid material such as steel or aluminum in weldment construction. However, molded plastic may also be utilized. The main frame 12 includes a generally U-shaped tubular member 18 and a transverse cross member 20 which are rigidly engaged and supported by wheels 28 held in spaced relationship at either end of the transverse cross member 20 by rigid mounting forks 30. A diagonal frame member 22 rigidly supports a diagonally positioned plate 24 in cooperation with U-shaped main frame member 18 as shown.

An elongated wooden handle 16 is supportively engaged along the length of plate 24 by U-bolts 26. These U-bolts 26 are quickly and easily manually tightenable and loosenable as by conventional wing nuts so that the handle 16 may be easily repositioned longitudinally in the direction of the arrow as desired to accommodate the particular height of the operator.

The floor cleaning assembly is disposed at the lower end of the diagonally oriented handle 16 and includes a metal connecting member 34 rigidly connected to an elongated support bar 32 and held in orthogonal relationship thereto by braces 36. The support bar 32 includes two spaced manually squeezable clips 38 which are biasingly openable and automatically clampable onto the bracket O of support plate L as previously described in FIGS. 2A and 2B. By appropriate positioning of rubber support members P within groove Q, the brackets O may be positioned so that each of the two support plates O abut one another centrally or in laterally offset fashion as desired with respect to the axis of handle 16. Alternately, where only a single element floor cleaning assembly is desired, the entire prior art device A shown in FIG. 1 may be combined with main frame 12 by clamping engagement between handle C of FIG. 1 and plate 24 and U-bolts 26 of FIG. 3.

As may now be more clearly understood, the device 10, when properly interengaged with support plates L having removable cleaning pads K attached to the bottom surfaces of support plates L, is self-supporting and may easily be rollably propelled and maneuvered manually by an operator who is unburdened with having to bear the weight of any part of the device. Thus, the entire arrangement, including main frame 12 resting atop the two spaced apart support wheels 28 and handle 16 with support bar 32, plate L or wire frame and cleaning pad K or cleaning cover B disposed at the respective lower end, is self-supporting with an appropriate amount of weight of the device bearing against the cleaning pads K.

By utilizing the preferred two-part hook and pile or VELCRO material N and M as shown in FIG. 2A, the cleaning pads K may be easily removed for laundering. For storage, the elongated support plates L may also be removed from clips 38 and support bar 32 by manual squeezing action of the clips 38.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A floor mopping device for cleaning a floor, said device comprising:

a rigid main frame including:

a generally U-shaped elongated member having first and second ends with a central portion therebetween and a transverse elongated cross member extending between and connected to said first and second ends, said members together defining a plane;

a floor engaging wheel connected at each end of said cross member and held for rotation about an axis generally parallel to said cross member by mounting forks;

an elongated diagonal member having first and second ends and connected at one end thereof to a central portion of said cross member, said diagonal member extending away from said plane;

an elongated generally flat diagonal plate connected to and extending between another end of said diagonal member and said central portion of said U-shaped member;

an elongated push handle connected to, and extending longitudinally in first and second directions from, said diagonal plate and adapted to be oriented by said diagonal plate at an acute angle to the floor;

an elongated flat support plate receiving a removable cleaning pad which is generally coextensive with a bottom surface of said support plate;

means for pivotally connecting said support plate to a lower end of said push handle;

said wheels and said support plate movably supporting said device in an upright position for use atop the floor.

2. A self-supported floor mopping device for cleaning a floor, said device comprising:

a main frame having two laterally spaced floor engaging wheels;

an elongated push handle connected to said main frame and adapted to be oriented by said main frame at an acute angle to the floor with a lower end of said push handle positioned forward of said main frame;

an elongated support bar having first and second ends and connected at a central portion thereof, and extending transversely with respect to, said push handle lower end;

two elongated flat support plates;

means for pivotally connecting, at a central portion thereof, said elongated flat support plates, respectively, to the first and second ends of said support bar such that said support plates lie in end-to-end relationship directly below said support bar;

a bottom surface of each said support plate having an elongated generally coextensive cleaning pad attached thereto.

* * * * *